US007610971B2

(12) United States Patent
Neff

(10) Patent No.: US 7,610,971 B2
(45) Date of Patent: Nov. 3, 2009

(54) ONE TRIP MILLING SYSTEM AND METHOD

(76) Inventor: Michael Claude Neff, 18 Hillview Road, Cults, Aberdeen, AB15 9HB (GB)

( * ) Notice: Subject to any disclaimer, the term of this patent is extended or adjusted under 35 U.S.C. 154(b) by 356 days.

(21) Appl. No.: 11/719,787

(22) PCT Filed: Nov. 4, 2005

(86) PCT No.: PCT/GB2005/004275

§ 371 (c)(1),
(2), (4) Date: May 21, 2007

(87) PCT Pub. No.: WO2006/056735

PCT Pub. Date: Jun. 1, 2006

(65) Prior Publication Data

US 2009/0133877 A1 May 28, 2009

(30) Foreign Application Priority Data

Nov. 23, 2004 (GB) ..... 0425768.9

(51) Int. Cl.
*E21B 29/06* (2006.01)
*E21B 7/08* (2006.01)

(52) U.S. Cl. ..... 175/61; 175/80; 166/117.5

(58) Field of Classification Search ..... 166/117.5, 166/117.6; 175/61, 80, 81
See application file for complete search history.

(56) References Cited

U.S. PATENT DOCUMENTS 2,553,874 A 5/1951 Spaulding et al.
5,657,820 A * 8/1997 Bailey et al. ..... 166/55.7
5,727,629 A 3/1998 Blizzard, Jr. et al.
5,771,972 A 6/1998 Dewey et al.
5,816,324 A * 10/1998 Swearingen et al. ..... 166/117.5
5,894,889 A 4/1999 Dewey et al.
6,209,645 B1 * 4/2001 Ohmer ..... 166/298
6,612,383 B2 9/2003 Desai et al.
6,648,068 B2 * 11/2003 Dewey et al. ..... 166/50
6,880,631 B1 * 4/2005 McGarian et al. ..... 166/117.6
2004/0089443 A1 5/2004 Dewey et al.

FOREIGN PATENT DOCUMENTS

WO WO01/66901 A1 9/2001

* cited by examiner

*Primary Examiner*—David J Bagnell
*Assistant Examiner*—David Andrews
(74) *Attorney, Agent, or Firm*—Neifeld IP Law, PC

(57) ABSTRACT

A sidetracking system has a pair of serially connected mills (8,9), each having a plurality of circumferentially arranged blades having a tapered cutting portion (82,93) thereon for cutting a window in a casing and then sidetracking in a formation. A whipstock has at least three axially spaced ramps, each ramp being interspaced by a substantially axially extending portion. Each of the ramps has the same angle of inclination to a longitudinal axis and the distance between the ramps is the same as the distance between the tapered portions on the mills (8,9) so that when, in operation, load is shared between both mills. The mills have a button (83,93) of hardened material located on the tapered cutting portions so that the button abrades the whipstock ramps (31,32,33).

12 Claims, 2 Drawing Sheets

ONE TRIP MILLING SYSTEM AND METHOD

BACKGROUND OF THE INVENTION

1. Field of the Invention

This invention relates to an apparatus and method for cutting a window through a tubular casing so as to drill a deviated borehole from an existing casing through geologic formations.

2. Description of the Related Art

It is known, for example, from U.S. Pat. No. 6,648,068 to have a well bore casing from which it is desired to "side track", and to lower a whipstock and tapered mill combination into the casing, anchor the whipstock to the casing when the whipstock has been appropriately oriented, break a link connecting the mill to the whipstock and to rotate the mill whilst moving it downwardly against the whipstock to cut a window through the casing wall and, thence, to continue cutting through formation in the desired direction.

As disclosed in U.S. Pat. No. 6,648,068, a whipstock may have ramps for moving the mill radially outwardly against an inside wall of the casing and there may be two ramps of about 15° interspaced by a further ramp having an angle of about 3° to a longitudinal axis of the casing. The mill is formed of plural circumferentially disposed radially extending blades, each having a taper of about 15° and the mill blades are faced with cutting material. Located upstream from the tapered mill may be sequentially positioned in the drill string a teardrop mill and a watermelon mill.

It will be understood that in the operation of cutting a window in the casing and sidetracking through formation to a new exploration site that energy production is ceased, thereby leading to a loss of revenue. Thus, it is desired to perform the milling and sidetracking operations as quickly as possible.

SUMMARY OF THE INVENTION

The present invention seeks to provide an apparatus and method which will achieve this object.

According to a first aspect of this invention there is provided a sidetracking system including a pair of axially connected mills located along a longitudinal axis, each mill having a plurality of tapered circumferentially disposed radially extending blades each having a tapered portion, at least some of the blades having a cutting surface thereon for cutting a window in a casing and then sidetracking in a formation, and a whipstock having at least three axially spaced ramps thereon, each ramp interspaced by a substantially axially extending portion, each said ramp being substantially the same angle of inclination to the longitudinal axis and also having the same angle of inclination as the taper on said tapered portion of the blades, the distance between the ramps being substantially the same as the distance between the tapered portions on the blades of the serially connected pair of mills, wherein the ramps support both mills before the mills cut the casing in which said system is located.

Preferably, an upstream mill has a larger diameter than a downstream mill and the upstream mill is arranged to cut the casing before the downstream mill.

Advantageously, a button element of hardened material is located toward a smaller diameter end of at least some of said blades on each of said mills for acting against the ramps to assist in preventing the mill from milling the whipstock ramps and to assist in moving the mills radially outwardly to cut said window.

Preferably, all said blades have a button element provided thereon.

Conveniently, said cutting surface is provided by one or more of natural diamond, polycrystalline diamond and tungsten carbide.

Preferably, said button elements each have a convex outer surface for abrading said whipstock.

Advantageously, said button elements are formed of natural diamond or polycrystalline diamond.

Advantageously, said angle of inclination of each ramp and the taper of said tapered portion on the blades is in the range 7° to 30° to the longitudinal axis and, preferably, 18° to the longitudinal axis.

In a feature of this invention there is provided a one trip milling system for cutting a window through tubular casing including a mill having a plurality of circumferentially disposed radially extending blades each having a tapered portion, at least some of said blades having a cutting surface thereon for cutting said window, and a button element of hardened material located toward a smaller diameter end of said blades and located on at least some of said blades for acting against a taper of a whipstock to move said mill radially outwardly to cut said window.

Preferably, all said blades have a cutting surface thereon.

Advantageously, said button element is provided on all said blades.

Conveniently, said cutting surface is one or more of natural diamond, polycrystalline diamond and tungsten carbide.

Preferably, said button elements each have a convex outer surface for abrading said whipstock.

In a preferred embodiment, two serially connected mills are provided, an upstream mill, in use, having a larger diameter than a downstream mill.

Advantageously, the taper on said tapered portion is in the range of 7° to 30° to a longitudinal axis of said system and, preferably, 18° to the longitudinal axis of said system.

According to a second aspect of this invention there is provided a method of sidetracking including the steps of:

lowering a pair of serially connected mills, releasably connected to a whipstock into a borehole casing, said mills each having a plurality of circumferentially disposed radially extending blades each having a tapered portion and said whipstock having at least three axially spaced ramps provided thereon, each said ramp being interspaced by a substantially axially extending portion, each ramp having substantially the same angle of inclination to the longitudinal axis and the taper on said tapered portion of said blades having a similar angle of inclination, the distance between the ramps being substantially the same as the distance between the tapered portion of blades, orienting the whipstock so that the ramps are angled toward a desired orientation for cutting a window in the casing and cutting through said formation to a desired new location, releasing the connection between the mills and the whipstock, rotating the mills and moving said mills downwardly so that the tapered blades of each respective mill abrade a respective ramp, downward movement of said mills against said ramps causing an upstream one of the mills to first cut the casing and continued downward movement causing the downstream mill to cut the casing, continued downward movement causing a window to be cut into the casing and sidetracking operations to be performed through formation.

Because the downstream mill has a smaller diameter than the upstream mill, so the rate of penetration is increased, thereby leading to faster sidetracking.

BRIEF DESCRIPTION OF THE DRAWINGS

The invention will now be described, by way of example, with reference to the accompanying drawings, in which:

In the Figures like reference numerals denote like parts.

Referring to FIG. 1, a borehole formed in a formation 1 is lined by a tubular, usually steel, casing 2. Positioned inside the casing is a whipstock 3 which, once the whipstock is appropriately oriented, is set in position within the casing by an anchor assembly operated, for example, by a hydraulic guideline 5 or, alternatively, the anchor may be mechanically set. A one trip milling system 6 having a longitudinal axis is formed on a drill string collar 7 by the series connection of a first mill 8 having plural circumferentially disposed radially extending blades, a second mill 9 also having plural circumferentially disposed radially extending blades, and a so-called melon mill 10. At least some of the tapered blades and, preferably, all the blades each have a cutting surface formed of one or more of natural diamond, polycrystalline diamond and tungsten carbide. The first mill has a smaller diameter than the second mill as explained hereinafter.

Figure 2:
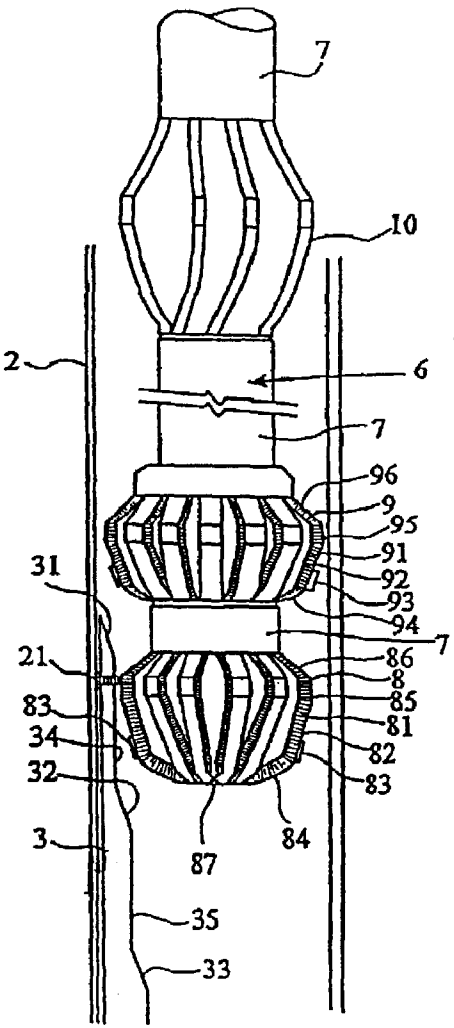

Initially, as shown in FIG. 2, the milling system 6 is secured to the whipstock 3 by a releasable connection 21. Usually the releasable connection is a frangible bolt 21 secured to the whipstock and, initially, also to the milling system, for example the first mill 8.

The whipstock 3 has an outer surface which is arcuately formed to approximately conform with the inside surface of the casing 2 and the whipstock has an internal arcuately formed concave surface for cooperating with mills of the milling system 6. The whipstock is provided with ramps 31, 32 and 33 longitudinally spaced along the whipstock, the ramps presenting an angle in the range 7° to 30° to the casing longitudinal axis and, preferably, 18° to the casing longitudinal axis. Three ramps are shown, although more ramps could be provided if desired. The ramps are interspaced by a substantially straight section 34, 35 presenting an angle of 0°-5° to the casing longitudinal axis.

Figure 5:
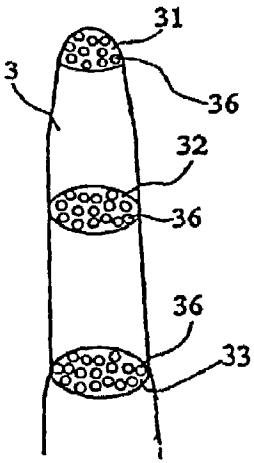
FIG. 5 shows a partial view of an internal surface of the whipstock.

As shown in FIG. 5, the ramp surfaces may be coated with diamond elements or tungsten carbide elements 36 to provide abrasion resistance to the milling systems 6. The elements are, preferably, brazed to the whipstock and may have flat or domed outer surfaces. More or fewer elements than shown may be employed.

Each of the first mill 8 and second mill 9 have plural blades 81, 91 having, for example, a parabolic shape with a substantially flat tapered portion 82, 92, which are each tapered in a direction in use to the bottom of the borehole to provide an angle of inclination to the longitudinal axis of the milling system of 7° to 30°, preferably 18°, and which is desirably conformed with the angle of the ramps 31, 32, 33 on the whipstock. Located on a lower portion of some or, preferably, each of the tapered portions 82, 92 is a button element 83, 93 of hardened material, for example natural diamond or polycrystalline diamond. The button element 83, 93 is recessed in an aperture in at least some of the blades, preferably all the blades, such that only 5%-10% of the button element protrudes from the blade. Typically, the amount of button element protruding is approximately 0.8 mm and the button element may have a flat or, preferably, convex outer surface to reduce abrasion against the ramps 31, 32, 33 of the whipstock. Preferably, the button elements are provided on all of the blades.

Both the blades 81, 91 have the tapered portion 82, 92 connected at a lower end thereof to a more angled cutting surface 84, 94 and at the upper end of the tapered portion is a substantially vertically extending cutting surface 85, 95, respectively which, in turn, is connected to an inwardly inclined cutting portion 86, 96, respectively. A lower end of the mill 8 is provided with an approximately horizontal cutting surface 87.

In operation, to perform sidetracking, the combination of whipstock and one trip milling system are connected together by the bolt 21 in the position shown in FIG. 2 and are lowered into the casing 2. When at the appropriate positional height within the casing, the anchor assembly 4, which is connected to the whipstock by a spigot 22, is oriented by rotation to have the desired polar coordinates to sidetrack to a new borehole location. The anchor assembly 4 is hydraulically set, in the preferred embodiment, via the hydraulic line 5 and the bolt 21 connection between the whipstock and milling system 6 is released, preferably frangibly, to sheer the bolt by moving the milling system vertically, upwardly or downwardly. In this respect, unlike the system shown in U.S. Pat. No. 6,648,068, because the lower, first mill 8 is not connected against one of the ramps 31, 32, but is located in an intermediate position, so it is possible to sheer the bolt 21 in a downwards direction.

When the milling system 6 is released from the whipstock, so the milling system is rotated and moved longitudinally downwardly within the casing 2 so that the button elements 83, 93 abrade the elements 36 on the ramps 31, 32. Because of the button elements 83, 93 and the elements 36, so the cutting milling surfaces of the mills 8, 9 are generally prevented from milling the ramps of the whipstock, which is a disadvantage of the prior art. Moreover, because it is arranged that the distance between the tapered portions of the first and second mills is the same as the distance between the ramps oh the whipstock, so each mill 8, 9 has blades which engage a respective ramp, thereby sharing the downward force that is applied to the milling system. Thus, the cutting load is shared approximately evenly between the ramps 31, 32 and it is, therefore, possible to increase the downward force using the present invention over the prior art where a single tapered mill engages a ramp. The button elements 83, 93 also reduce the risk of cutting into the whipstock rather than the casing.

Figure 1:
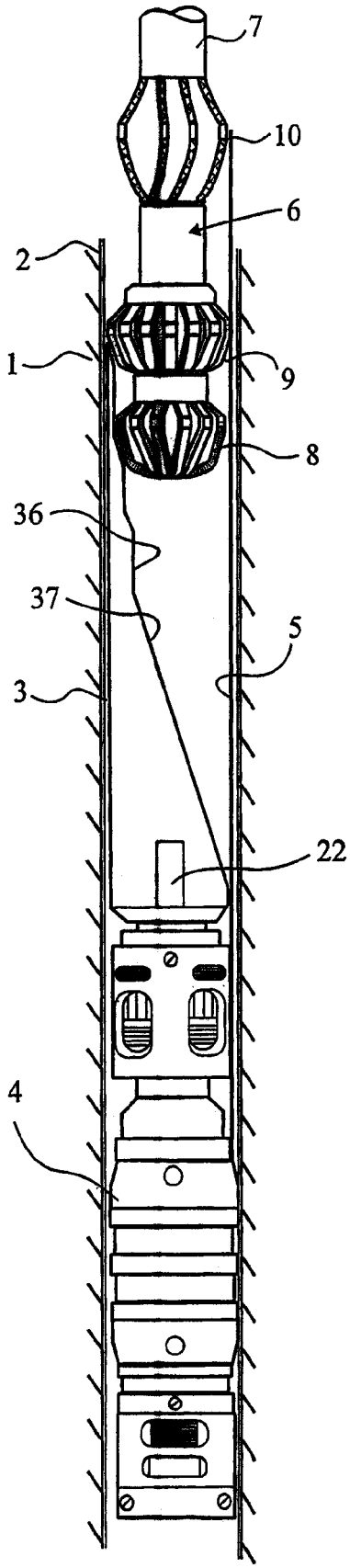
FIG. 1 shows a sidetracking system in accordance with this invention located in a longitudinal cross-section of a casing.
Figure 4:
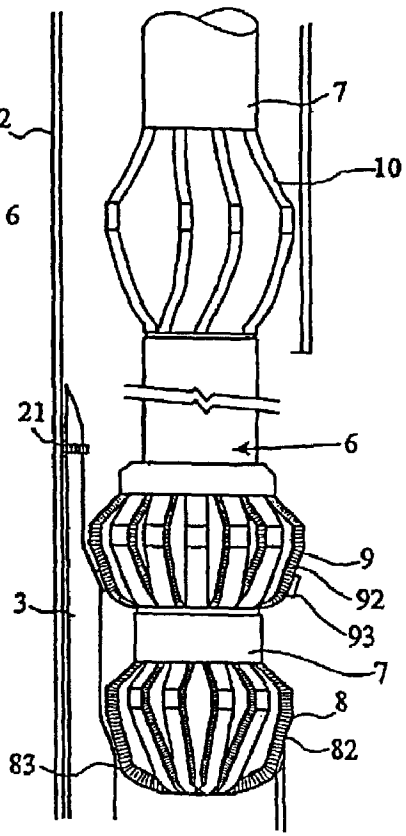
FIGS. 2, 3 and 4 show partial views of different operational positions of the mill along a whipstock during window cutting operations within the casing.
Figure 3:
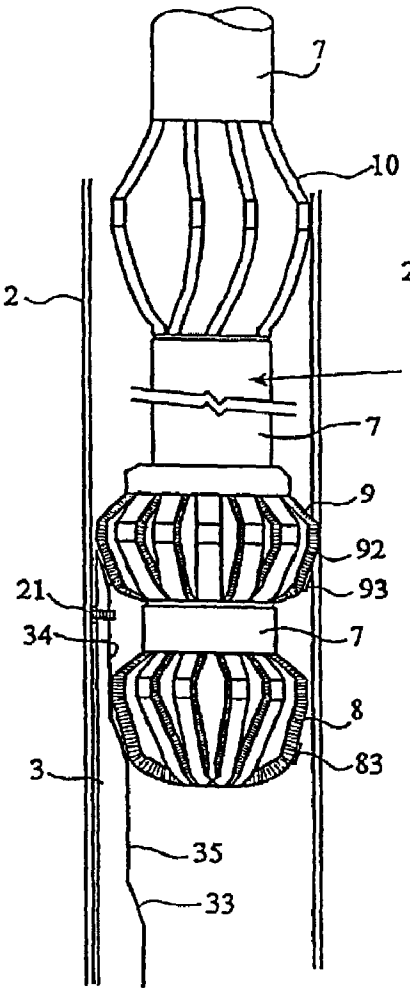

In the position shown in FIG. 3, the axially, longitudinally lower, first mill 8 has an outer diameter which is smaller than that of the upstream second mill 9 and is of such a diameter that it is able to be located alongside straight section 34 and the second mill 9 has a diameter which is slightly less than the internal diameter of the casing 2. It is desirable that the cutting surface at least starts to cut the window before the button element touches the casing wall. With the mill blades moving longitudinally down the respective ramps 31, 32, so the milling system is deflected off axis toward the right (as shown in the Figures) with the result that the cutting surface of the blades 91 starts to cut a window in the casing 2. With continued movement along the ramps 31, 32, so the first mill cutting surfaces are also brought into contact with the casing wall and commence milling a further window.

When the mills 8, 9 have traversed the straight section 35, 34, so the window being milled by the upstream mill 9 opens into the window milled by the first mill 8. Further downward movement of the mills 8, 9 causes them to move along ramps 32, 33 and for the milling system to be further deflected until as the blades of mill 9 abrade ramp 33, so mill 8 is no longer in contact with the whipstock, but is moved into cutting formation as it then travels along a further straight section 36 and a tapered section 37 having an angle typically in the range 3° to 15° to the longitudinal axis.

Because the leading mill, i.e. downstream, first mill 8 has a smaller diameter than the mill 9, so greater rate of penetration is achievable particularly through formation. Continued downward movement of the milling system causes the mills to exit the casing 2 and to cut through formation 1 toward a new drilling location.

It is to be understood that modifications could be made and that all such modifications falling within the spirit and scope of the appended claims are intended to be included in the present invention.

The invention claimed is:

1. A sidetracking system including a pair of axially connected mills located along a longitudinal axis, each mill having a plurality of tapered circumferentially disposed radially extending blades each having a tapered portion, at least some of the blades having a cutting surface thereon for cutting a window in a casing and then sidetracking in a formation, and a whipstock having at least three axially spaced ramps thereon, each ramp interspaced by a substantially axially extending portion, each said ramp being substantially the same angle of inclination to the longitudinal axis and also having the same angle of inclination as the taper on said tapered portion of the blades, the distance between the ramps being substantially the same as the distance between the tapered portions on the blades of the serially connected pair of mills, wherein the ramps support both mills before the mills cut the casing in which said system is located.

2. A system as claimed in claim 1, wherein an upstream mill has a larger diameter than a downstream mill and the upstream mill is arranged to cut the casing before the downstream mill.

3. A system as claimed in claim 1, wherein a button element of hardened material is located toward a smaller diameter end of at least some of said blades on each of said mills for acting against the ramps to assist in preventing the mill from milling the whipstock ramps and to assist in moving the mills radially outwardly to cut said window.

4. A system as claimed in claim 1, wherein all said blades have a button element provided thereon.

5. A system as claimed in claim 1, wherein said cutting surface is provided by one or more of natural diamond, polycrystalline diamond and tungsten carbide.

6. A system as claimed in claim 4, wherein said button elements each have a convex outer surface for abrading said whipstock.

7. A system as claimed in claim 4, wherein said button elements are formed of natural diamond or polycrystalline diamond.

8. A system as claimed in claim 1, wherein said angle of inclination of each ramp and the taper of said tapered portion on the blades is in the range 7° to 30° to the longitudinal axis.

9. A system as claimed in claim 8, wherein said angle is 18° to the longitudinal axis.

10. A method of sidetracking including the steps of:

lowering a pair of serially connected mills, releasably connected to a whipstock into a borehole casing said mills each having a plurality of circumferentially disposed radially extending blades each having a tapered portion and said whipstock having at least three axially spaced ramps provided thereon, each said ramp being interspaced by a substantially axially extending portion, each ramp having substantially the same angle of inclination to the longitudinal axis and the taper on said tapered portion of said blades having a similar angle of inclination, the distance between the ramps being substantially the same as the distance between the tapered portion of blades, orienting the whipstock so that the ramps are angled toward a desired orientation for cutting a window in the casing and cutting through said formation to a desired new location, releasing the connection between the mills and the whipstock, rotating the mills and moving said mills downwardly so that the tapered blades of each respective mill abrade a respective ramp, downward movement of said mills against said ramps causing an upstream one of the mills to first cut the casing and continued downward movement causing the downstream mill to cut the casing, continued downward movement causing a window to be cut into the casing and sidetracking operations to be performed through formation.

11. A method as claimed in claim 10, wherein an upstream mill has a larger diameter than a downstream mill and the upstream mill is arranged to cut the casing before the downstream mill.

12. A sidetracking system including a pair of axially connected mills located along a longitudinal axis, each mill having a plurality of tapered circumferentially disposed radially extending blades each having a tapered portion, at least some of the blades having a cutting surface thereon for cutting a window in a casing and then sidetracking in a formation, and a whipstock having at least three axially spaced ramps thereon, each ramp interspaced by a substantially axially extending portion, each said ramp being substantially the same angle of inclination to the longitudinal axis and also having the same angle of inclination as the taper on said tapered portion of the blades, the distance between the ramps being substantially the same as the distance between the tapered portions on the blades of the serially connected pair of mills, wherein the ramps support both mills before the mills cut the casing in which said system is located and an upstream mill has a larger diameter than a downstream mill and the upstream mill is adapted to cut the casing before the downstream mill.

* * * * *